US005120235A

United States Patent [19]

Kashiwa

[11] Patent Number: 5,120,235

[45] Date of Patent: Jun. 9, 1992

[54] INSULATION DISPLACEMENT CONNECTOR

[75] Inventor: Yoichi Kashiwa, Wakabayashi, Japan

[73] Assignee: AMP Incorporated, Harrisburg, Pa.

[21] Appl. No.: 704,904

[22] Filed: May 22, 1991

Related U.S. Application Data

[63] Continuation of Ser. No. 525,513, May 18, 1990, abandoned.

[30] Foreign Application Priority Data

May 19, 1989 [JP] Japan ..... 1-57773

[51] Int. Cl.[5] ..... H01R 4/24

[52] U.S. Cl. ..... 439/405; 439/399; 439/460

[58] Field of Search ..... 439/395–407, 439/449, 460, 452

[56] References Cited

U.S. PATENT DOCUMENTS 4,653,831 3/1987 Wilson et al. ..... 439/449
4,836,803 6/1989 Seidel ..... 439/719

FOREIGN PATENT DOCUMENTS 0001118 12/1979 PCT Int'l Appl. ..... 439/418
2197548 5/1988 United Kingdom ..... 439/399

*Primary Examiner*—David L. Pirlot
*Attorney, Agent, or Firm*—Adrian J. LaRue; Allan B. Osborne

[57] ABSTRACT

An electrical connector (100') having a plurality of contacts (10) positioned in a dielectric housing (20') for terminating respective electrical wires (1) and a plurality of wire retaining grooves (70, 80) on the housing (20') for receiving and retaining respective electrical wires (1), each groove (70, 80) being provided with projections (**72*a*, 72*b*, 82*a*, 82*b*) on respective sidewalls (74, 84) wherein the projections (72*a*, 72*b*, 82*a*, 82*b***) are positioned at different depths relative to each other.

2 Claims, 4 Drawing Sheets

INSULATION DISPLACEMENT CONNECTOR

This application is a continuation of application Ser. No. 07/525,513 filed May 18, 1990, now abandoned.

The invention relates to electrical connectors and more particularly to wire retaining means on such connectors.

BACKGROUND OF THE INVENTION

Connectors have widely been used for conveniently connecting and disconnecting a large number of signal lines. Among many connectors, insulation displacement connectors are known for making electrical connection between the conductor of an insulated electrical wire and a contact by simply forcing the insulated electrical wire into such contact, to break the insulator, thereby eliminating the need for stripping the insulator at the end of the insulated electrical wire in order to solder or crimp the conductor to the contact.

Illustrated in FIG. 4 is an exploded perspective view of one example of one such conventional insulation displacement connector 100. A large number of contacts 10 are inserted in a large number of grooves 21 provided in a housing 20 at a predetermined pitch. Although not shown in FIG. 4, the grooves 21 are also provided in the lower side of the housing 20 to receive contacts 10 from below. The contacts 10 are provided with mating sections 11 at their front portions for making electrical contact with contacts of another matable connector (not shown) and insulation displacement connection (IDC) sections 12 at their rear portions for receiving sections 1*a* of the insulated electrical wires 1 (see FIG. 1) for electrically engaging conductors 2 of the insulated electrical wires 1.

On pushing the insulated electrical wires 1 into V-grooves 12*a* of the IDC sections 12, the insulation layers 3 are severed for making electrical contact with conductor 2. Sections 1*b* of electrical wires 1 are pushed into wire retention grooves 22 in housing 20 simultaneously with the insertion of end sections 1*a* into IDC sections 12 of the contacts 10, thereby securing the insulated electrical wires 1 in connector 100.

The housing 20 including the insulated electrical wires 1 connected to the contacts 10 in the manner described above is coupled to another housing 30. The assembly is then sandwiched between upper and lower covers 40 (only lower cover is shown in FIG. 4) before being covered with a metal cover 50 from the front end to complete the insulation displacement connector 100.

Illustrated in FIG. 5 is a front view of the electrical wire retention grooves 22 of housing 20 for the insulation displacement connector 100 of FIG. 4 as seen from the ends of electrical wires 1.

There are formed projections 23 in each electrical wire retention groove 22 adjacent to its entrance in such a manner as to limit the width of the entrance smaller than the diameter of the electrical wire 1. The electrical wires 1 are forced into the respective grooves 22 through the narrower entrance and are retained in the grooves 22 by downwardly facing shoulders 23*a* of projections 23.

Illustrated in FIG. 6 is a simplified view of electrical wire 1 just before being inserted into the IDC section 12 of the contact and in the wire retention groove 22 in housing 20. The electrical wire 1 is placed over the IDC section 12 and the wire retention groove 22 and is then inserted into the IDC section 12 and the electrical wire retention groove 22 by tool 60. The insertion tool 60 has grooves 61, 62 at positions corresponding to the IDC section 12 and the electrical wire retention groove 22 so that the electrical wire 1 is pushed down at both sides of both the IDC section 12 and the electrical wire retention groove 22.

As described hereinbefore, the electrical wires 1 are inserted and held in the electrical wire retention grooves 22. However, the grooves 22 are forced to widen their entrances by the electrical wires 1 hitting the projections (see FIG. 5) when the electrical wires 1 are being inserted in the electrical wire retention groove 22 by the insertion tool 60. This tends to deform the housing 20 downwardly at and near its center portion of the back end portion (lower right portion in FIG. 4) as shown by an arrow A.

If such deformation occurs, not only the electrical wire retention grooves 22 but also the contacts 10 tend to move in the direction as shown by an arrow B in FIG. 6. There may be an instance that the IDC sections 12 move beyond the groove 61 in the insertion tool 60 as shown by the dashed line C. If the insertion tool 60 is operated to push down the electrical wires 1 under this condition, the IDC sections 12 are crushed by the insertion tool 60 and no proper electrical connections can be made between corresponding conductors 2 of the electrical wires 1 and the contacts 10.

Also, widening the electrical wire retention grooves 22 may cause misalignment between the pitch of the electrical wires 1 and the IDC sections 12 of the contacts 10 disposed in the housing 20. This may result in the electrical wires 1 riding over the blades 12*b* of the IDC sections 12 of the contacts 10 (see FIG. 4) and cutting the conductors 2 by blades 12*b* when the electrical wires 1 are pushed down.

Illustrated in FIG. 7 is a cross section view of another conventional electrical wire retention grooves 22'.

The provision of projections 24 extending downwardly at a certain slope as illustrated in FIG. 7 rather than the simple projections 23 in FIG. 5 may be effective to solve the above problem because the deformation of such projections 24 during insertion of the electrical wires in the grooves 22, absorbs the force which would otherwise widen grooves 22'.

However, in order to enjoy the effectiveness of such downward projections 24, such projections must have a proper length thereby requiring higher raised portions 26 to form the electrical wire retention grooves 22' and making the insulation displacement connector bulky. There are increasing needs for compact connectors having a large number of signal carrying contacts at a small pitch therebetween. In this case, the width of each raised portions 26 must be small and forming such slanted downward projections is increasingly difficult.

In light of the above problems, it is proposed to provide the present device which is intended to provide an electrical connector free from such deformation and suitable for miniaturization.

SUMMARY OF THE INVENTION

According to the invention an electrical connector is provided which comprises a plurality of contacts having insulation displacement sections for electrically terminating respective conductors of insulated electrical wires and a like plurality of wire retention grooves for securing the wires to the connector housing. Each groove includes projections on both facing walls and which are at different depth positions relative to each other.

DESCRIPTION OF THE INVENTION

Figure 1:
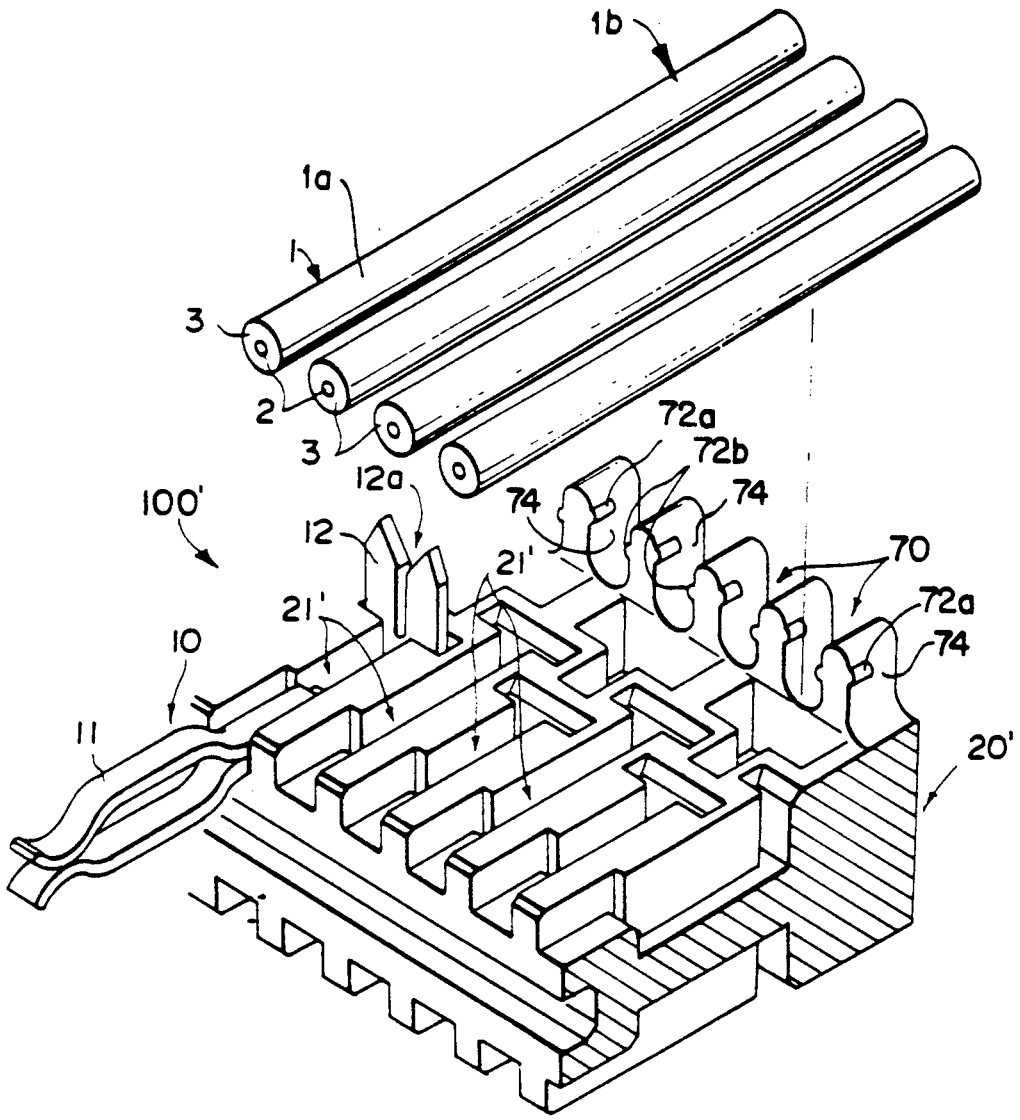
FIG. 1 is a perspective view of a part of the housing as well as electrical wires and contacts of the insulation displacement connector according to one embodiment of this device.
Figure 4:
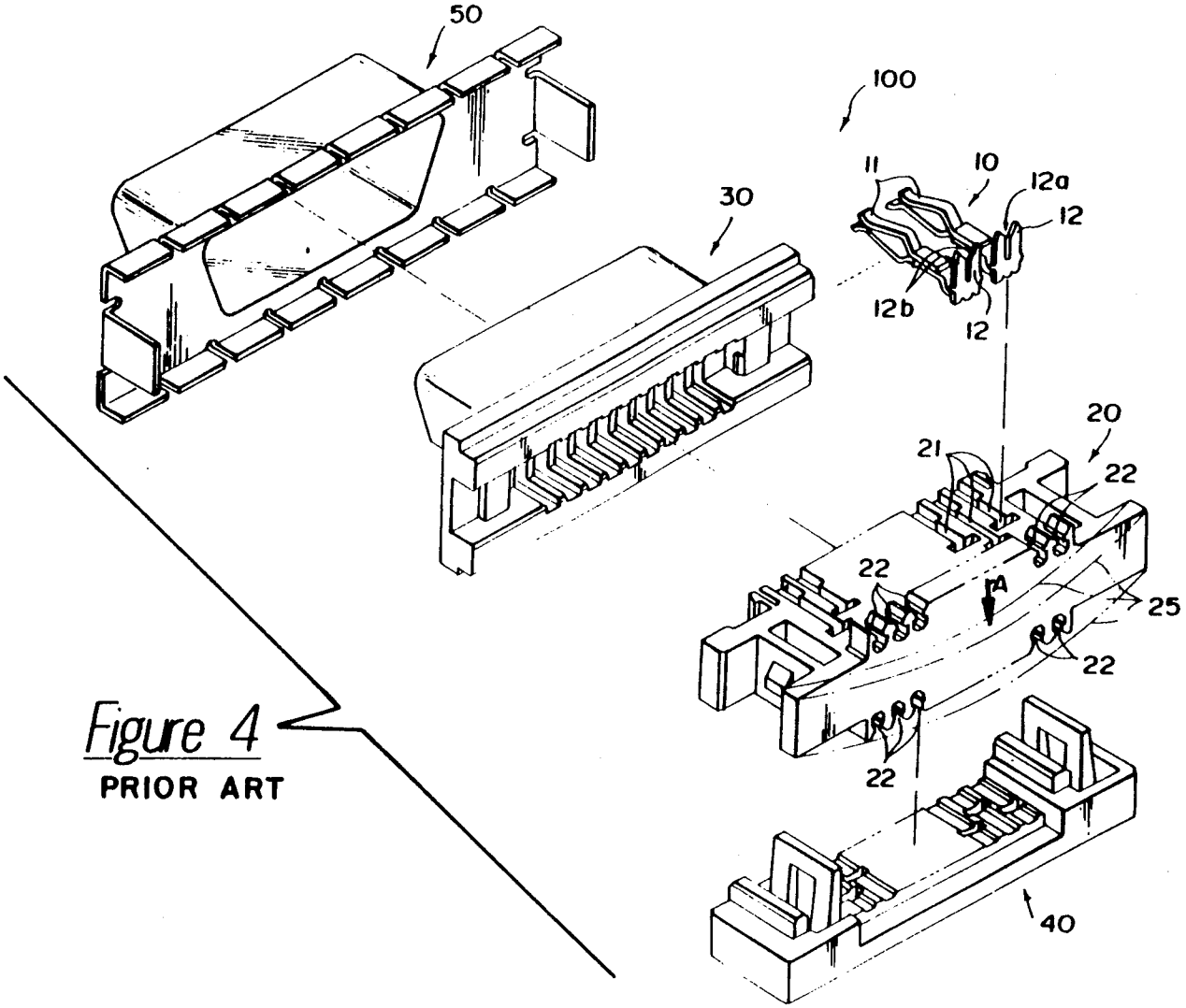
Figure 4 PRIOR ART
FIG. 4 is an exploded perspective view of one example of a conventional insulation displacement connectors.
Figure 5:
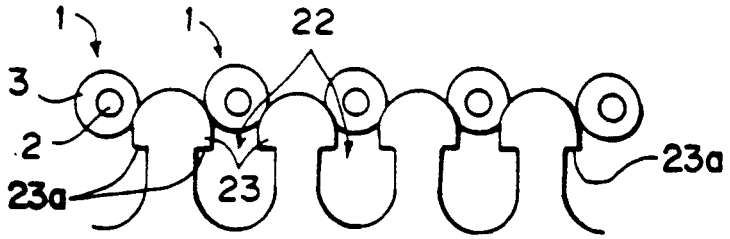
PRIOR ART Figure 5
FIG. 5 is a front view of the electrical wire retention grooves in the housing of the insulation displacement connector of FIG. 4.
Figure 6:
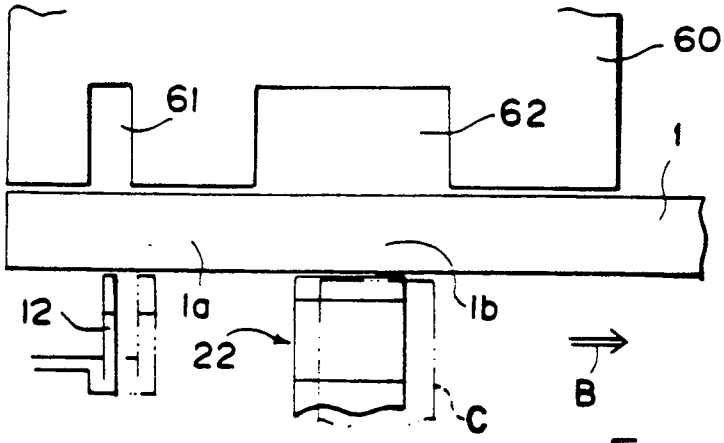
Figure 6 PRIOR ART
FIG. 6 is a simplified drawing of an electrical wire just before being inserted in the IDC section of the contact and the electrical wire retention groove in the housing.

Illustrated in FIG. 1 is a perspective view of a part of housing 20' as well as electrical wires 1 and contacts 10 of one embodiment of the insulation displacement connector 100'. The housing 20' is equivalent to the housing 20 in FIG. 4 and therefore no detailed description is required.

The electrical wires 1 are forced into the IDC sections 12 of the contacts 10 disposed in the grooves 21' and also in the electrical wire retention grooves 70.

Figure 2:
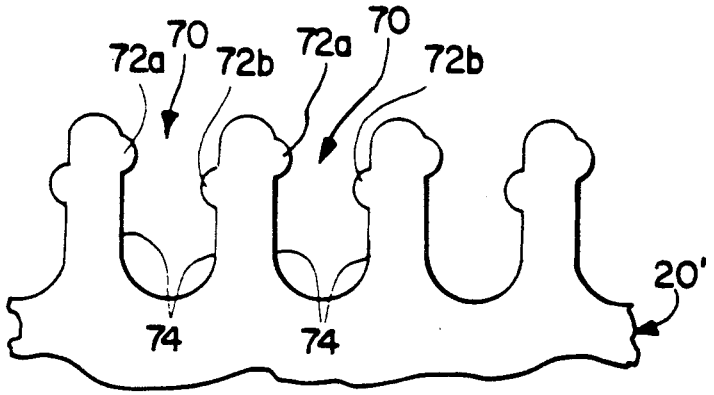
FIG. 2 is a front view of the electrical wire retention grooves of FIG. 1.

FIG. 2 is a front view of the electrical wire retention grooves 70 illustrated in FIG. 1.

There are provided a pair of projections 72*a*, 72*b* on both sidewalls 74 of each retaining groove 70 at different depth positions. The electrical wires 1 tend to widen the electrical wire retention grooves 70 upon hitting the projections 72*a*, 72*b*. The projections 72*a*, 72*b*, however, being shifted in the direction of insertion, thereby minimizes the force which would otherwise widen the grooves 70 and thus effectively avoid the aforementioned problems associated with the deformation of the conventional housing grooves 22.

Figure 7:
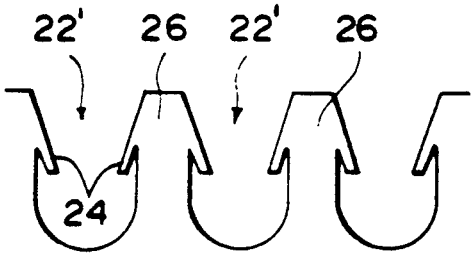
Figure 7 PRIOR ART
FIG. 7 is another example of conventional electrical wire retention grooves.

Also, the electrical wire retention grooves 70 are simple in shape as compared with the electrical wire retention grooves 22' in FIG. 7 and are simpler to manufacture.

Figure 3A:
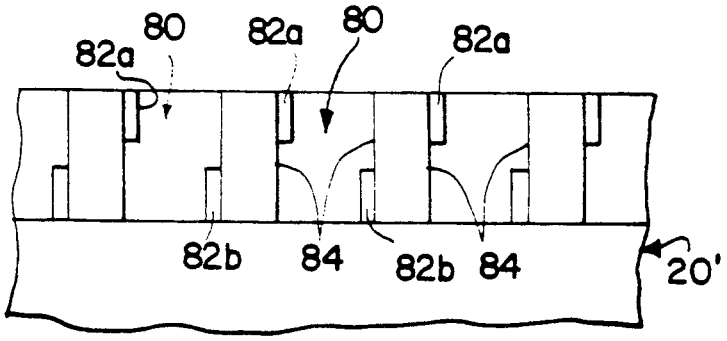
FIGS. 3A and 3B are respectively plan and front views of the electrical wire retention grooves of the insulation displacement connector according to another embodiment of the present device.
Figure 3B:
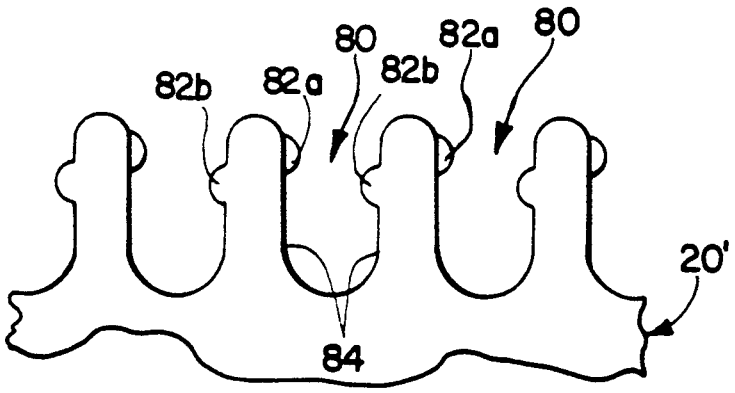

Illustrated in FIGS. 3A and 3B are plan and front views of electrical wire retention grooves 80 in accordance with another embodiment of connector 100'.

The projections 82*a*, 82*b* provided on both sidewalls 84 of the electrical wire retention grooves 80 are not only shifted in the depth direction but also in the length direction (vertical direction in FIG. 3A) of the electrical wire retention grooves 80. In this particular configuration, the force to widen the electrical wire retention grooves 80 during insertion of the electrical wire 1 therein is further distributed to suppress deformation of the housing.

As described in detail hereinbefore, the insulation displacement connector according to the present device features the provision of the projections on the both sidewalls of each electrical wire retention groove at different depth positions therealong. The force to widen each electrical wire retention groove during insertion of the electrical wires into the electrical wire retention grooves is effectively distributed to minimize deformation of the housing. Also the wire retention grooves are simple and suitable for miniature connectors.

I claim:

1. An electrical connector, comprising:

a dielectric housing having a plurality of electrical contacts secured in said housing;

electrical termination sections of said electrical contacts positioned for electrical termination to respective electrical wires;

said housing having U-shaped wire retention grooves in alignment with said electrical termination sections for receiving the electrical wires therein when the wires are terminated to the termination sections;

each of said grooves being defined by a floor, facing side walls and an arcuate-shaped projection on one side wall facing directly towards a location on an opposite side wall not having a projection and cooperating therewith to locally reduce the width of said groove.

2. The electrical connector of claim 1 wherein said opposite side wall includes a projection facing directly towards said one side wall and spaced from said projection thereon.

* * * * *